United States Patent [19]

Pauly et al.

[11] 4,173,095

[45] Nov. 6, 1979

[54] TOY VEHICLE

[75] Inventors: Ronald R. Pauly, Mound; Royce D. Rumsey, Hopkins, both of Minn.

[73] Assignee: Tonka Corporation, Spring Park, Minn.

[21] Appl. No.: 794,729

[22] Filed: May 9, 1977

[51] Int. Cl.[2] ..... A63H 17/00

[52] U.S. Cl. ..... 46/201; 46/222

[58] Field of Search ..... 46/1 B, 17, 201, 202, 46/221, 222

[56] References Cited

U.S. PATENT DOCUMENTS

| | | | |
|---|---|---|---|
| 3,107,453 | 10/1963 | Balthazor | 46/221 |
| 3,629,068 | 12/1971 | Linstead | 46/17 |
| 3,643,372 | 2/1972 | Nash et al. | 46/201 |

*Primary Examiner*—Louis G. Mancene
*Assistant Examiner*—Robert F. Cutting
*Attorney, Agent, or Firm*—Norman P. Friederichs

[57] ABSTRACT

A toy vehicle is disclosed which may resemble a jeep. The toy vehicle may include a chassis, an inside compartment, wheels and a top. The inside compartment may have seats, wall panels and a floor. The compartment may serve to enclose various raw edges of the chassis. The top may include support posts which rest on the chassis.

15 Claims, 9 Drawing Figures

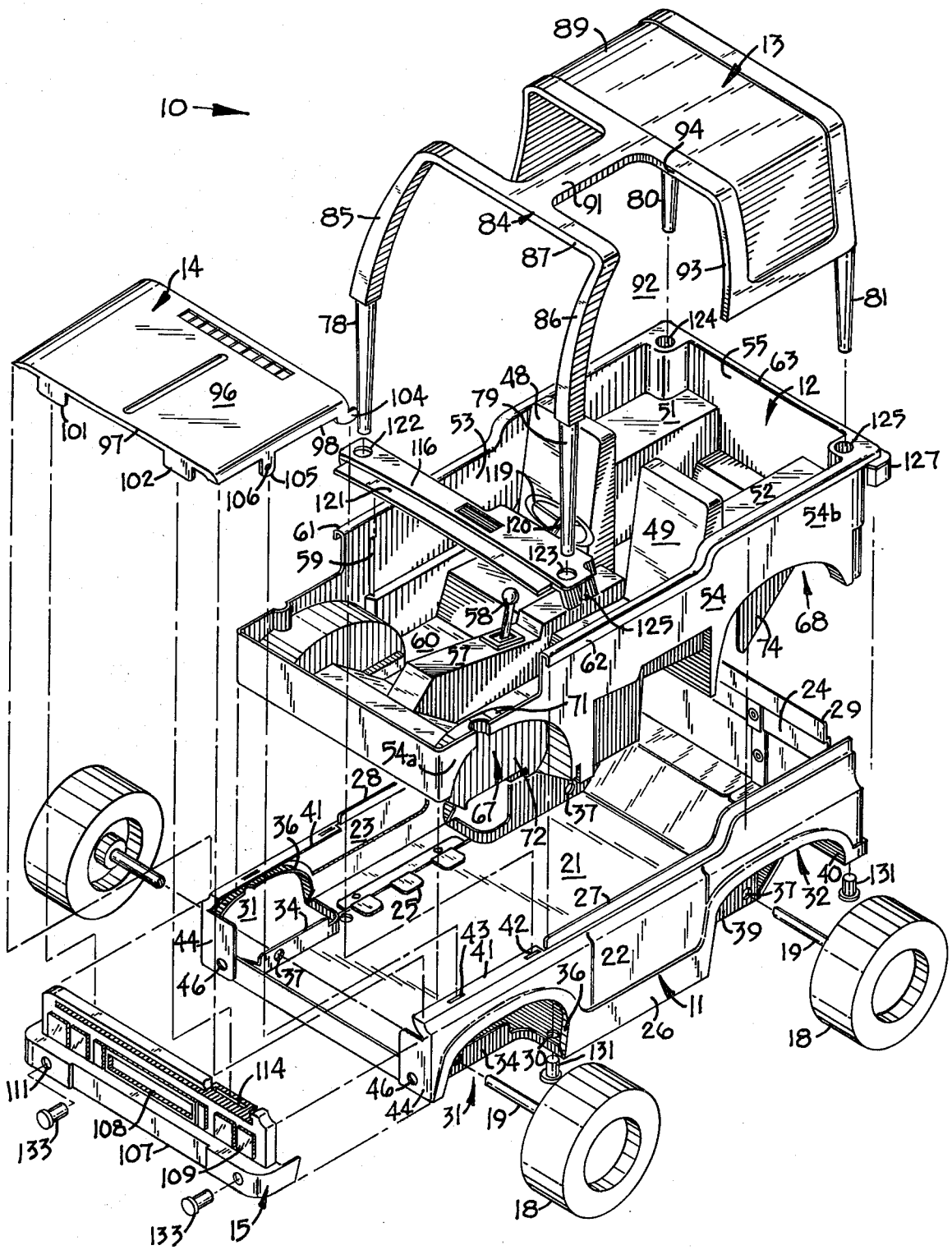
FIG. I

FIG. II
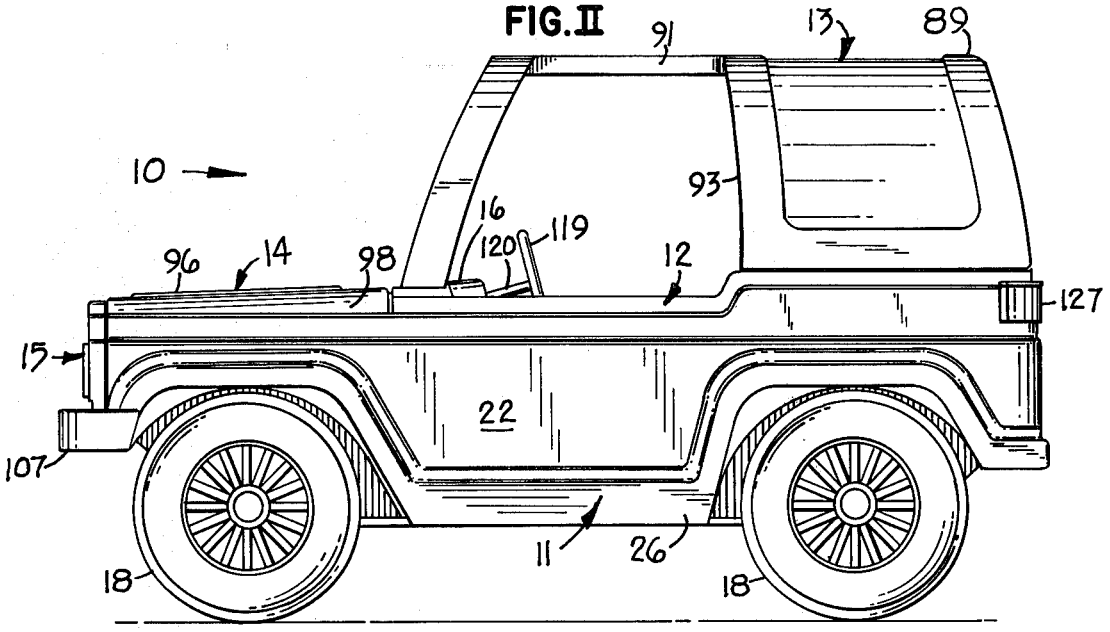
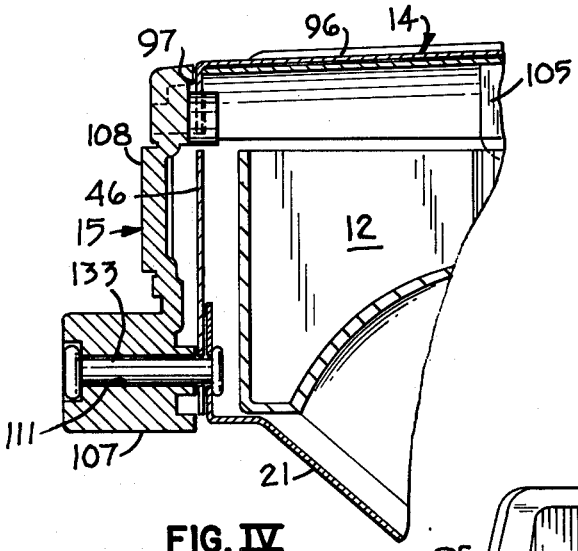
FIG. IV
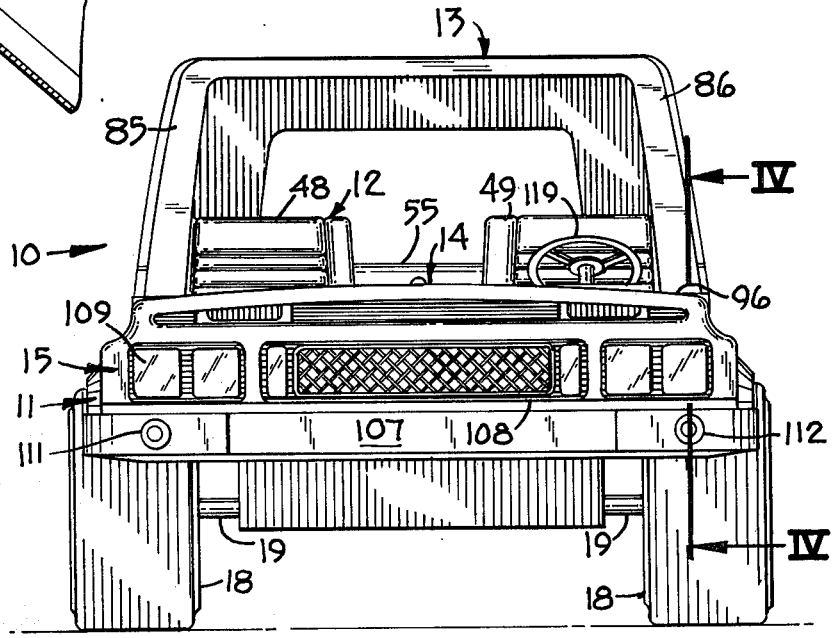
FIG. III

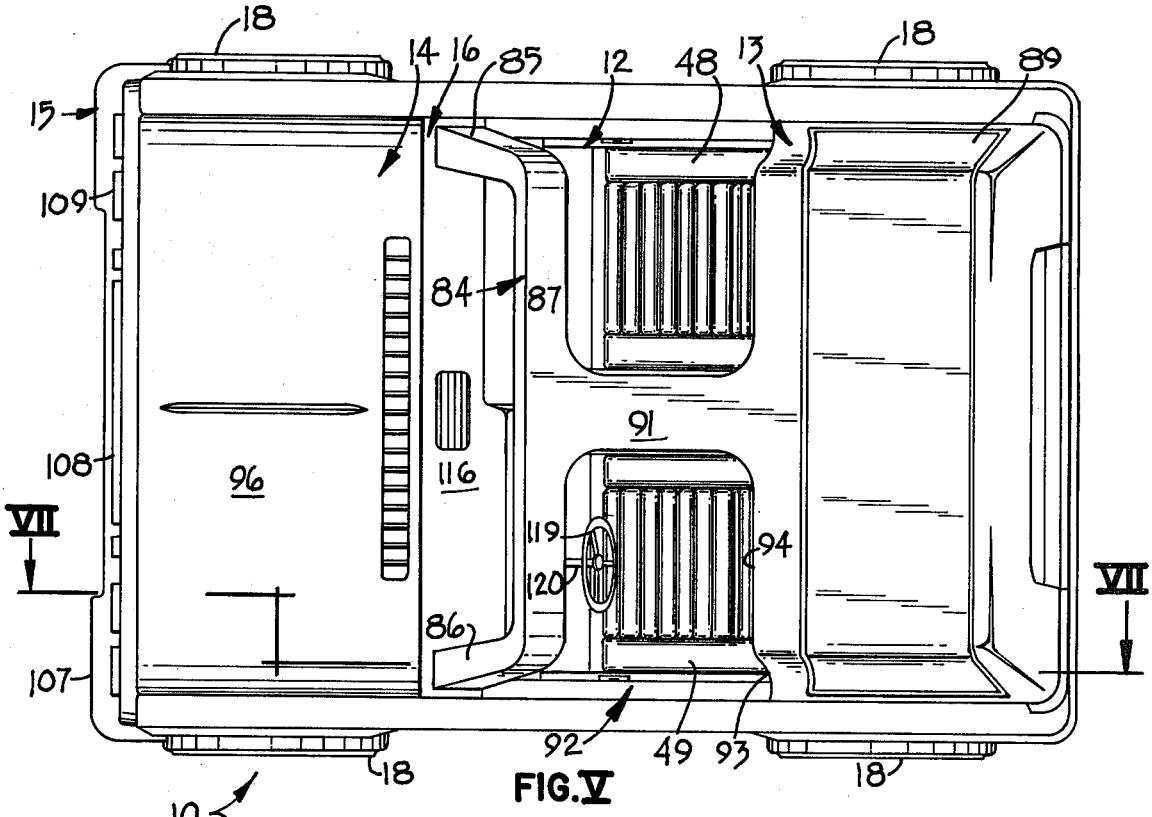
FIG. V
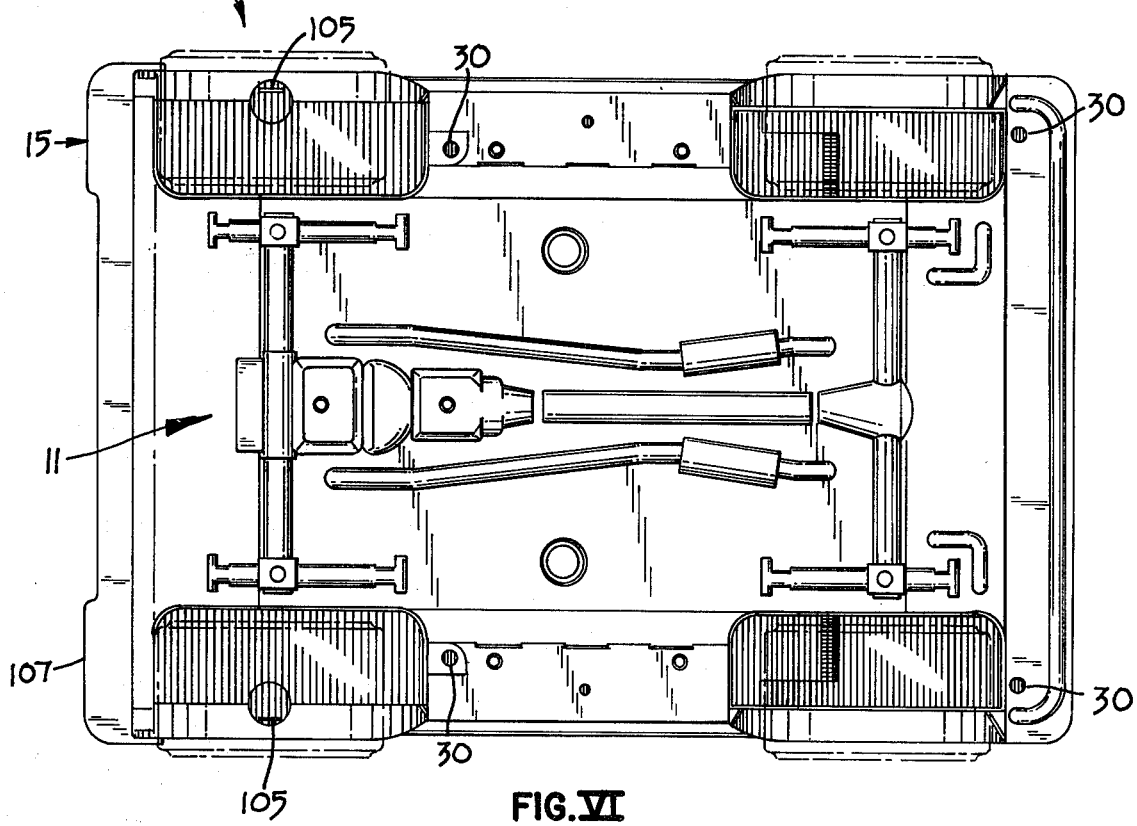
FIG. VI

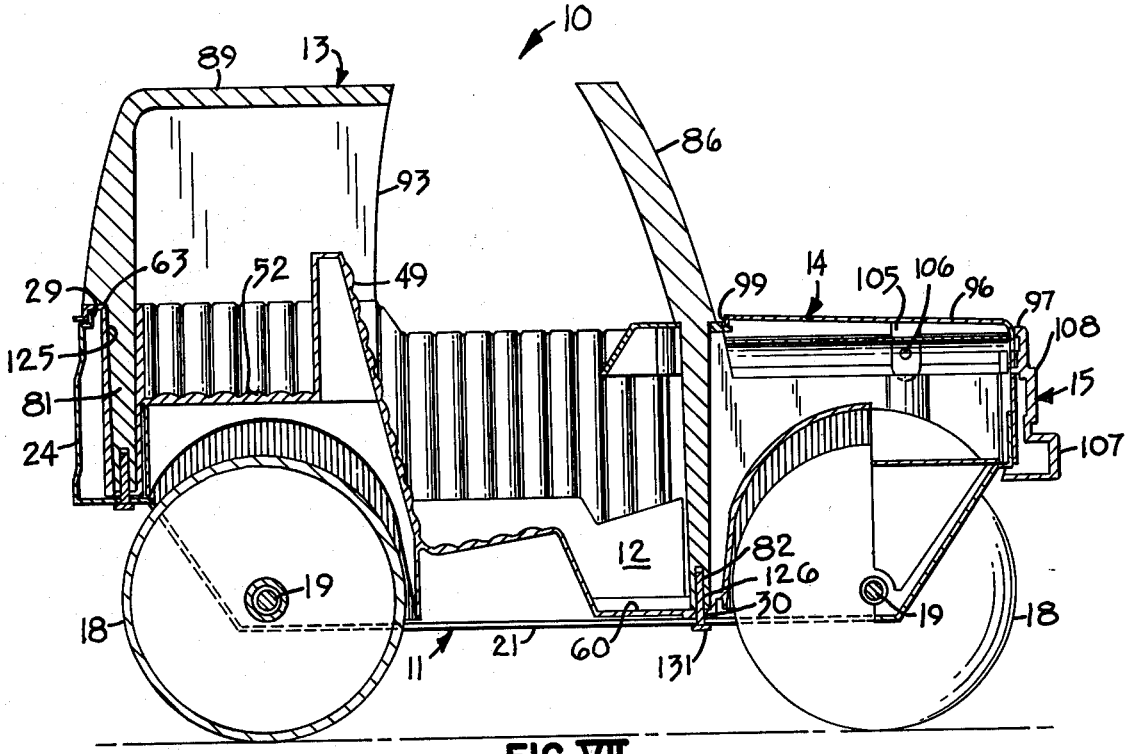
FIG. VII
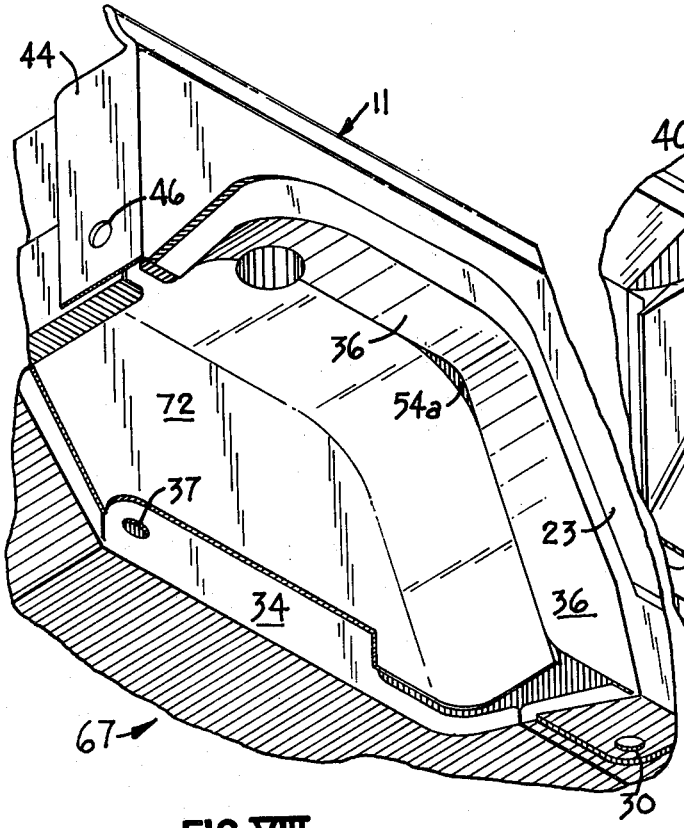
FIG. VIII
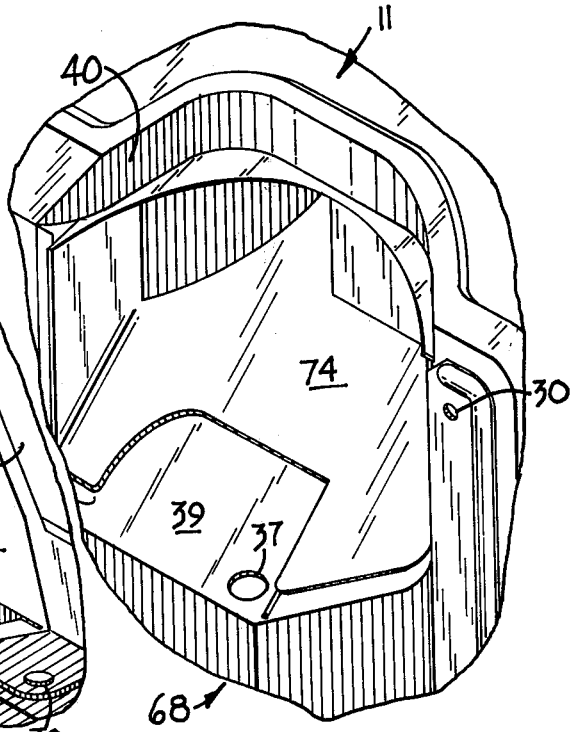
FIG. IX

TOY VEHICLE

BACKGROUND OF THE INVENTION

The present invention relates generally to toys and more particular to the construction of miniature toy vehicles.

In the past, a variety of toy vehicles have been available in various sizes, shapes and colors. Toy vehicles have been available of a size and construction adequate to permit a child to climb into the vehicle and peddle the vehicle down the sidewalk. Other toy vehicles have been provided on which the child may set while he scoots across the floor. The latter typically being of a tricycle type. Still other toys have been provided which are primarily for handling. The child may grasp the vehicle by one hand and move the vehicle along a surface as though the toy were being driven. Ruggedness has been an important attribute in children's toys. Children have been known to sit on, stand on, stamp on, and otherwise roughly treat toys.

Safety has been of paramount interest in toy vehicles. In the past, some problem has been encountered particularly with toy vehicles constructed of metal sheet having raw metal edges which are inherently sharp and thus may cause cuts and/or scratches if the toy is not properly handled. One method of overcoming such sharp edges has been to bend or curl the metal so as to make the sharp edge inaccessible.

Efficiency in assembly is an important attribute for any manufactured article. This is particularly true today when manufacturing costs are on a continuing upward rise.

GENERAL DESCRIPTION OF THE PRESENT INVENTION

The present toy vehicle may include a chassis, a passenger compartment and a top. The chassis, preferably of metal, may have a bottom pan and upwardly extending sides. A plurality of wheel wells may be defined in the sides and bottom of the chassis. The chassis may be formed by cutting and stamping sheet metal into the desired shape. The passenger compartment may be molded of an impact resistant plastic material and may have the general appearance of the inside of an automobile, including seats,. transmission counsel and the like. The top likewise may be constructed of an impact resistant plastic material and may be molded into the desired shape. The toy vehicle may have a plurality of wheels rotatably mounted on axle shafts so that a child in play may move the vehicle about on its wheels in a manner realistically resembling movement of a full-sized automobile.

The present invention provides a toy vehicle which is rugged in construction, efficient in assembly and has added safety features. The various parts of the vehicle may be coordinated in such a manner that only a very few fastening devices, such as pegs or screws are necessary, in the construction of the toy vehicle. The toy vehicle may have a top which serves to hold various other portions of the vehicle, such as the passenger compartment and dashboard in place. One embodiment of the present invention is a toy vehicle having a construction which is particularly rugged. In such embodiment, the top includes a plurality of downwardly extending posts which are supported by the bottom portion of the chassis. The present toy vehicle may include a further important feature in which various raw edges may be protected from exposure in a novel manner. For example, in one embodiment, a passenger compartment serves to protect sharp edges both along the bottom portion of the chassis, such as around the wheel wells, and around the upper portion of the side walls of the chassis.

IN THE DRAWINGS

FIG. I shows an exploded perspective view of one embodiment of the present invention;

FIG. II shows a side view of the assembled toy vehicle;

FIG. III is a front view of the toy vehicle of FIG. II;

FIG. IV is a sectional view taken along the line IV—IV of FIG. III;

FIG. V is a top view;

FIG. VI is a bottom view;

FIG. VII is a sectional view taken along the line VII—VII in FIG. V;

FIG. VIII is a perspective view of a front wheel well of the toy vehicle;

FIG. IX is a view of a rear wheel well.

DETAILED DESCRIPTION OF THE PRESENT INVENTION

The toy vehicle 10 of the present invention, a preferred embodiment of which is shown in FIGS. I–IX of the drawings, may include a lower body shell or chassis 11, a passenger compartment 12, a top 13, a hood 14 and a combination bumper grill 15. The toy vehicle 10 may further include a plurality of wheels 18 and corresponding axels 19.

The chassis or lower body shell 11 (FIG. I) may be constructed of sheet material preferably metal and includes a bottom or belly pan 21, a pair of side panels 22, 23 and a rear panel 24. The chassis 11 may be formed by any suitable manner such as by cutting and stamping. The chassis 11 may be formed from a single sheet or alternatively may be formed from two or more sheets appropriately secured together in the finished form such as by tabs 25. In other words, the bottom 21 may be formed of one sheet and the panels 22, 23 and 24 formed from a separate sheet. The panels 22, 23 and 24 may include suitable slots through which tabs 25 may extend thereby securing the panels 22–24 to the bottom 21.

The panels 22 and 23 may be mirror images of each other and the description will be directed primarily to wall 22. Like numerals will designate like portions on both panels 22 and 23. Panel 22 may include suitable decorative shaping such as ridge 26 outlining wheel well and rocker panel portions of side 22. The side panels 22, 23 and rear panel 24 may each include an upper raw edge 27 and 29, respectively. In other words, the edges 27 and 29 may merely extend upwardly and need not be curled.

The side panels 22, 23 and bottom 21 may have suitable openings defined therein, such as to provide front wheel well 31 and rear wheel well 32. The wheel well 31 may include an upwardly extending flange 34 at bottom pan 21 and inwardly extending flange 36 at side panel 22. The flange 34 may have an opening 37 defined therein through which axle 19 may extend. The rear wheel well 32 may likewise include an upwardly extending flange 39 at bottom 21 and an inwardly extending flange 40 at side panel 22. The side panel 22 may have an inwardly extending upper portion 41 with a pair of slots 42 and 43 defined therein. Panel 22 may further have an inwardly extenting front flange 44 with an opening 46 defined therein.

The passenger compartment or inner body shell 12 may be of a size suitable for snug insertion into the chassis 11. The passenger compartment 12 may be molded of a plastic material and typically may include front passenger seat 48, driver's seat 49 and rear, inwardly facing passenger seats 51, 52. The passenger compartment includes side walls 53, 54 and rear wall 55. The walls 53–55 and the seats 48, 49, 51 and 52 may be provided with a shaped or textured surface resembling upholstry in an automobile. The walls 52 and 53 have a guide member 59 for engagement with dash 16. The passenger compartment 12 may further include floor 60 and a transmission counsel 57, with a gearshift 58. The side walls 53, 54 and rear wall 55 each have an upper lip or channel 61, 62 and 63, respectively. The lips 61–63 may each be substantially U-shaped in cross-section and are adapted for overlying the upwardly extending flanges or raw edges 27 and 29, respectively.

The passenger compartment 12 may further include wheel well portions such as 67, 68. The front wheel well portion 67 may include a radial wall 71 and an inner wall 72. The rear portion of radial wall 71 and inner wall 72 may provide a lip or channel which overlies and encases the upwardly extending flange 34 in the assembled toy vehicle. The forward portion 54*a* of wall 54 may lie immediately adjacent the inwardly extending flanges 36 of chassis wall 23 in sufficiently close proximity to protect the raw edge of flange 36. In a similar manner, rear wheel well portion 68 may include an inner downwardly extending wall 74 which may overlie flange 39. The rear portion 54*b* of compartment wall 54 abuts flange 40 of chassis 12.

The top 13 (FIGS. I and V) of toy vehicle 10 may have a plurality of downwardly extending posts 78, 79, 80 and 81. The top 13 further may include a bar-like structure resembling a windshield frame 84. The window frame 84 may include a pair of uprights 85, 86 and an inner connecting horizontal member 87. The top 13 includes a rear cover portion 89 and a bar 91 interconnecting the windshield frame 84 and rear cover 89. The forward portion of the top 13 when viewed from above, has the appearance of a "T" and defines an opening 92 having a vertical component 93 and a horizontal component 94. Such opening may serve special purposes as hereinafter described. The top 13 may be composed of any suitable material such as a high impact plastic and may be shaped as by molding.

The hood 14 (FIGS. I and VII) may include a surface portion 96, a front downwardly extending flange 97, a side downwardly extending flange 98 and a rear downwardly extending flange 99. The front flange 97 desirably includes a pair of spaced tabs 101 and 102 for purposes hereinafter described. The side flanges 98 may each include a rear, hook-shaped tab 104 and a forwardly spaced tab 105. The tab 105 may have an opening 106 therein for purposes hereinafter described.

The bumper grill assembly 15 (FIGS. I, III and IV) may have a forwardly facing surface in which is molded a bumper 107, a grill 108 and a plurality of headlights 109. The bumper 107 has a pair of openings defined therein, 111 and 112 which align with openings 46 in lower body shell 11. A pair of pockets or cavities 113 and 114 extend rearwardly adjacent the upper portion of bumper grill 15. The cavities 113 and 114 are suitable for reception of the tabs 101 and 102.

The dashboard 16 (FIGS. I and VII) may include an upper surface member 116 and a downwardly extending surface member 117. The surface member 117 may have speedometer dials, clock and the like molded into the surface thereof. A steering wheel 119 and steering wheel shaft 120 may be mounted on the dash 16. The dash 16 may have a forwardly extending flange 121 for extending beneath hood 14. The dash 16 has a pair of openings 122 and 123 defined therein. The openings 122 and 123 are suitable for reception of the posts 78 and 79 of top 13. The dash 16 has a channel 125 at each side such as for reception of guide 59 of sidewall 53.

The top vehicle may include a tail light 127 which may be a molded portion of compartment 12 or may be independantly attached to chassis 11.

ASSEMBLY OF THE TOY VEHICLE

The toy vehicle may be assembled by first attaching bumper grill 15 to shell 11. A peg 133 is inserted through opening 112 in bumper grill 15 and opening 46 in body shell 11 thereby locking bumper grill 15 to the chassis or lower body shell 11. The inner shell or passenger compartment 12 is inserted into the lower body shell 11 in such a manner that the flange portions 27, 28 and 29 of shell 11 are positioned into the U-shaped cavities of lip members 61, 62 and 63 of inner shell 12. The lips 61–63 thereby protect and conceal the raw edges of 27 and 29. The dash 16 is mounted in its appropriate location with regard to the inner shell 11. The top 13 is next placed in position with the post 78 extending through opening 122, post 79 extending through opening 123, post 80 extending through opening 124 and post 81 extending through opening 125. A peg such as 131 (See FIG. VIII) is inserted through opening 30 in bottom pan 21, through opening 59 in inner shell 12 and into the opening 82 in post 79. The peg 131 thus locks the top 13, inner shell 12 and outer shell 11 together. In a similar manner, pegs are inserted to lock the remaining posts 78, 80 and 81.

The hood 14 may be mounted by inserting flange 104 into slot 42 and pivoting the hood forwardly and downwardly until the tab 105 is inserted through slot 43. The tab 105 may then be twisted from beneath thereby locking the hood 14 to the outer shell 11. Tabs 101 and 102 (FIG. IV) are inserted into cavities 113 and 144, thus, locking the upper portion of bumper grill 15 against forward movement. Finally, the axle 19 may be inserted through openings 37 in lower body shell 11 and wheels 18 mounted thereon. The wheels 18 may be locked with respect to axle 19 by a suitable washer cap type retainer (not shown) or by frictional engagement.

In the assembled condition, the toy may be rolled about on its wheels. The opening 92 may be utilized for inserting a doll into the drivers seat or into the passenger's seat. Since the posts 78 through 81 of top 13 extend downward into the vehicle to a supporting position adjacent the pan 21, the toy can support a substantial weight from above, thus it is capable of supporting added weight if the child sits or stands on the toy.

Various modifications, of course, can be made without departing from the broader scope of the present invention.

What is claimed is:

1. A toy vehicle comprising wheels, a chassis, simulated passenger compartment and cab roof, said chassis including a bottom pan, upwardly extending sides, and a plurality of wheel wells, said cab roof including a plurality of substantially vertically oriented, downwardly extending posts, said posts extending to a position adjacent said bottom pan, said posts serving to support said cab roof directly on said bottom pan, said posts securing said passenger compartment to said chassis whereby any external forces applied to the cab roof are transmitted through said posts to said bottom pan.

2. The toy vehicle of claim 1 wherein said chassis is constructed of metal sheet material.

3. The toy vehicle of claim 2 wherein said chassis has raw metal edges and wherein said passenger compartment protects substantially all of said raw metal edges from exposure.

4. The toy vehicle of claim 2 wherein said sheet metal chassis has raw metal edges both along the upper portion of said sides and along said wheel wells, and wherein said passenger compartment protects both said upper metal edges and said wheel well edges.

5. The toy vehicle of claim 1 wherein said vehicle includes peg fastening means which extend through said bottom pan and into said posts.

6. The toy vehicle of claim 5 wherein said vehicle further includes a dash board, said dash board having at least two openings defined therein for alignment with and receipt of said posts, said posts serving to entrap said dash board between said top and said passenger compartment.

7. A toy vehicle comprising wheels, a chassis and a simulated passenger compartment said chassis being constructed of metal sheet and including a bottom, integral upwardly extending sides and wheel wells formed in said bottom and sides, said sides having upper raw metal edges, said wheel wells having raw metal edges, said passenger compartment including means to protect both said upper metal edges and said wheel well metal edges from exposure.

8. The toy vehicle of claim 7 wherein said means for protecting said raw metal edges comprise a lip, said lip being substantially U-shaped in cross-section and serving to enclose said raw metal edges.

9. The toy vehicle of claim 7 wherein said means for protecting said upper raw metal edges comprise a lip, said lip being substantially U-shaped in cross-section, said lip serving to encase said upper raw metal edges, and wherein said means for protecting said wheel well raw metal edges comprise surface means disposed substantially perpendicular to said wheel well raw metal edges.

10. The toy vehicle of claim 9 wherein said means for protecting said wheel well raw metal edges further includes sheet means, said sheet means overlying some of said wheel well raw metal edges.

11. The toy vehicle of claim 10 wherein said vehicle includes a hood, said hood being constructed of metal sheet and having a raw metal edge along the rear portion thereof, said toy vehicle further including a dash board portion, said dash board portion having means to protect said hood raw metal edge.

12. The toy vehicle of claim 11 wherein said vehicle includes a bumper-grille member, said bumper-grille member including upwardly opening slot means at the upper portion thereof, said hood including downwardly extending tab means, said tab means being disposed in said slot means to secure said bumper-grille member to said vehicle and prevent forward movement of said member away from said vehicle, said vehicle further including fastening means to secure said bumper-grille member to vehicle with respect to vertically downward movement.

13. The toy vehicle of claim 11 wherein said vehicle includes top means, the forward portion of said top means comprising T-shaped bar means defining a pair of openings each of said openings including a vertical component and a horizontal component, each of said openings being adapted for insertion of a doll figure therethrough.

14. The toy vehicle of claim 13 wherein said top means includes a plurality of downwardly extending posts, the bottom ends of said posts being supported by said chassis adjacent the bottom of said chassis.

15. The toy vehicle of claim 13 wherein said posts are adapted to secure said chassis, said passenger compartment and said top together as an integral unit.

* * * * *